US006422721B1

(12) United States Patent
Plunk et al.

(10) Patent No.: US 6,422,721 B1
(45) Date of Patent: Jul. 23, 2002

(54) TUBE GUARD SYSTEM

(75) Inventors: Carlton Plunk, Saltillo; Mike Miller, Tupelo, both of MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/575,504

(22) Filed: May 22, 2000

(51) Int. Cl.[7] ..... F21V 15/04
(52) U.S. Cl. ..... 362/377; 362/217; 313/312
(58) Field of Search ..... 362/217, 260, 362/255, 377, 256, 376; 313/312, 489, 493, 442

(56) References Cited

U.S. PATENT DOCUMENTS 3,179,792 A * 4/1965 Weiss ..... 362/226
3,673,401 A 6/1972 Du Pont
3,720,826 A 3/1973 Gilmore et al.
3,808,495 A 4/1974 Win
4,112,485 A 9/1978 Sutter
4,280,169 A * 7/1981 Allen ..... 362/217
4,642,741 A 2/1987 Cohn
4,841,418 A 6/1989 Davis
4,924,368 A * 5/1990 Northorp ..... 362/376
5,006,970 A * 4/1991 Mackiewicz ..... 362/217
5,291,379 A 3/1994 Lu
5,536,998 A 7/1996 Sica

* cited by examiner

*Primary Examiner*—Sandra O'Shea
*Assistant Examiner*—Hargobind S. Sawhney
(74) *Attorney, Agent, or Firm*—Charles G. Lamb; Middleton Reutlinger

(57) ABSTRACT

A tube guard system is provided for use in a flourescent light fixture and comprises at least one lamp assembly. The lamp assembly further comprises a lamp having two ends and having at least one terminal at each end, a sleeve having two ends and surrounding the lamp, and an end cap having a concentric opening formed thereupon affixed to each end of the sleeve whereby the terminals protrude through the openings in the end caps. A pair of lampholders affixed to the fixture receive each lamp used in the fixture whereby the terminals are placed in contacting relation with the lampholders. A preferred lampholder has a lamp center line of at least 5/8", thereby allowing the use of low-profile lampholders having a lamp center line of 5/8", or standard lampholders having a lamp center line of 7/8". Preferred sleeves and end caps are of polycarbonate materials in order to provide heat and ultra violet resistance. Lampholders are mounted to lampholder saddles, as desired, which are in turn mounted to the light fixture.

13 Claims, 5 Drawing Sheets

TUBE GUARD SYSTEM

BACKGROUND OF THE INVENTION

1. Technical Field

This invention relates to lighting fixtures and particularly to a tube guard system for use with low-profile lampholders and lamps mounted in high-profile lampholders.

2. Description of Relevant Art

Various means are currently used to protect flourescent lamp tubes from impact and to allow selective filtering or coloring of light that emanates from associated light fixtures. These means are intended for use with high-profile lampholders, such as those commonly found in the industry which have a lamp center line of ⅞". Such means typically add bulk and weight to flourescent lamps. Current means do not capitalize on the benefits of using low-profile lampholders, such as those commonly found in the industry which have a lamp center line of ⅝" from a lampholder saddle, and associated narrow diameter lamps. Furthermore, serious installation difficulties arise when a user attempts to fit current lamp protection means to low-profile lampholders. As a result, current lamp protection means make it very difficult to get lamps so protected into a light fixture. What is needed is a tube guard system including end caps, sleeves, and brackets which can be used with low-profile lampholders and narrow diameter lamps, such as, for example, T-8 lamps as well as with high-profile lampholders, and which is simple and easy to use.

SUMMARY OF THE INVENTION

It is an object of the present invention to provide lamp protection for flourescent lamps fitted into low-profile lampholders.

It is another object of the present invention to provide a tube guard system which will protect flourescent lamps mounted in either low-profile or high-profile lampholders.

It is even another object of the present invention to provide a tube guard system which resists ultra violet deterioration, preselectably filters ultra violet radiation, and accepts low-profile lampholders.

More particularly, this invention relates to a tube guard system including end caps, sleeves, and brackets which is provided for use in a flourescent light fixture. Specifically, a preferred tube guard system comprises two brackets affixed to the fixture, and at least one lampholder affixed to each bracket. A preferred lampholder has a lamp center line of ⅝" or larger, thereby allowing the use of low-profile lampholders having a lamp center line of ⅝". If a larger lamp center line is chosen, standard high-profile lampholders having a lamp center line of ⅞" may be used. The tube guard system also includes at least one lamp assembly further comprising a lamp having two ends and at least one terminal at each end, a sleeve having two ends and surrounding the lamp, and two end caps. Each end cap has a concentric opening formed thereupon and is affixed to each end of the sleeve whereby the lamp terminals protrude through the openings in the end caps, and the terminals are thereby placed in contacting relation with the lampholder. Preferred sleeves and end caps are of polycarbonate materials in order to provide ultra violet resistance.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
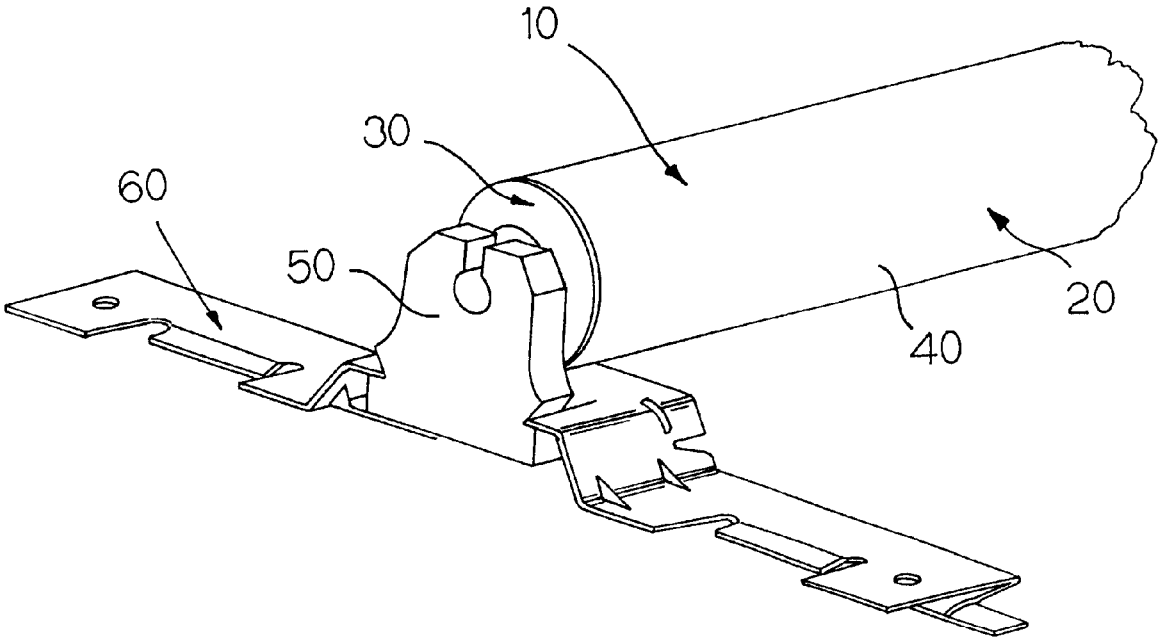
FIG. 1 is a perspective view of a tube guard system of the present invention.
Figure 5:
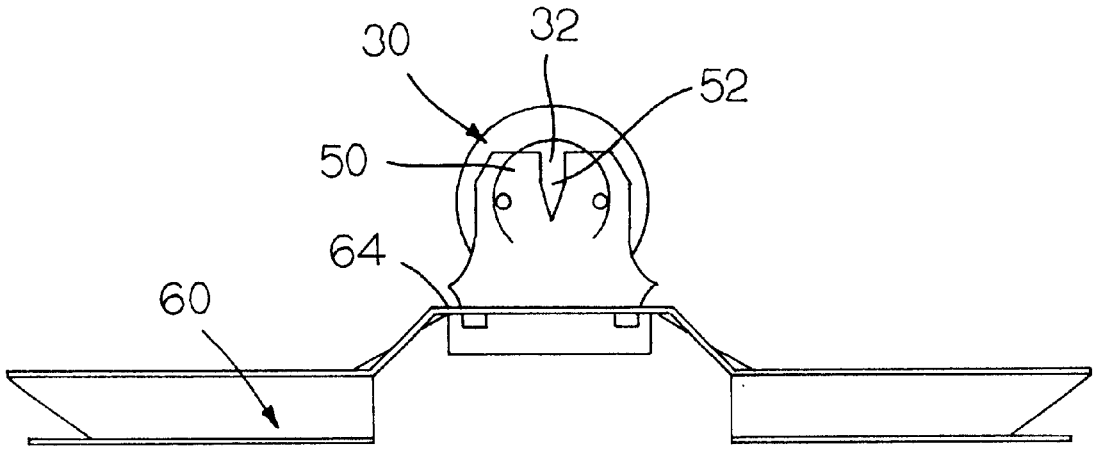
FIG. 5 is a sectional view of a tube guard system of the present invention taken along line 5—5 of FIG. 3.

As shown in FIG. 1, a tube guard system 10 is provided for use in a flourescent light fixture (not shown). The tube guard system 10 includes at least one lamp assembly 20 further including end caps 30, a sleeve 40, two lampholders 50, and two brackets 60. The brackets 60 are affixed to the fixture (not shown), and the lampholders 50 are affixed to the brackets 60. In light fixtures (not shown) using more than one lamp assembly 20, multiple pairs of lampholders 50 are affixed to the brackets 60 such that the lamp assemblies 20 are preferably parallel to one another.

As shown in FIGS. 2*a*–6*e*, the at least one lamp assembly 20 of the tube guard system 10 further comprises a lamp 52 having two ends and having at least one terminal (not shown) at each end. The sleeve 40 has two ends and surrounds the lamp 52. Once the sleeve 40 is in place surrounding the lamp 52, the end caps 30 are affixed, further surrounding the lamp 52. Each end cap 30 has a concentric opening 32 formed thereupon, and is affixed to each end of the sleeve 40 whereby the terminals (not shown) of the lamp 52 protrude through the openings 32 in the end caps 30. In such fashion, the terminals (not shown) are placed in contacting relation, both mechanically and electrically, with the lampholder 50.

A preferred lampholder 50 has a lamp center line of ⅝" thereby allowing the use of low-profile lampholders 50 having a lamp center line of ⅝" and thereby accommodating the use of T-8 lamps 52, or other lamps 52 of a 1" diameter. In another preferred embodiment, where a larger lamp center line is chosen, standard high-profile lampholders 50 having a lamp center line of ⅞" may be used. The lamp assembly 20 of the present invention will readily fit into both low-profile and high-profile lampholders 50, thereby solving a current problem in the art.

Figure 4:
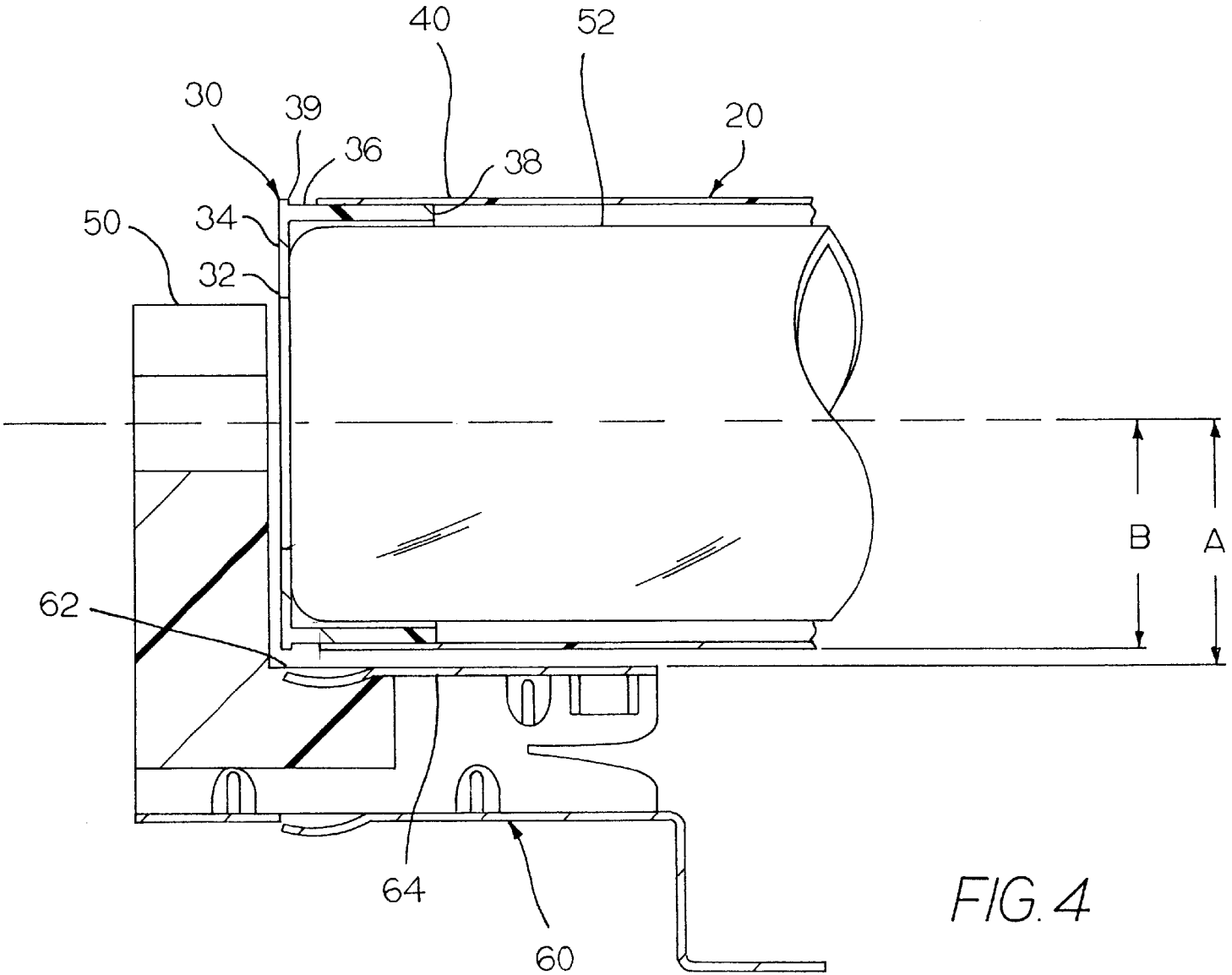
FIG. 4 is a sectional view of a tube guard system of the present invention taken along line 4—4 of FIG. 3 showing relevant details.

Referring to FIG. 4, a lamp 52 centerline is denoted by a dashed line running horizontally across the Fig. from left to right. Using a T-8 bulb of 1" diameter, a distance out from the lamp 52 centerline to an edge of the lamp 52 is 0.500". Dimension "A" in FIG. 4 is a distance out from the lamp 52 centerline to either a lampholder 50, or a base 62 of a lampholder saddle 64, if such a saddle 64 is used, which receives the lampholder 50. Dimension "A" is preferably ⅝" or 0.625" when using a low-profile lampholder 50. Dimension "B" is the distance from the lamp 52 centerline out to the sleeve 40, and is preferably 0.548", again, when using a low-profile lampholder 50. Allowing for negligible thickness of the sleeve 40, free-air clearance between the lamp 52 and the sleeve 40 is of a range from 0.030" to 0.072". This free-air clearance is significantly less than that found on current tube guards. Accordingly, heat dissipation is a significant factor in materials selection. Preferred sleeves 40 and end caps 30 are of polycarbonate or high-heat polypropylene materials in order to resist heat and to provide ultra violet resistance, both factors of which might otherwise degrade the integrity of their structure over time, making them brittle and more susceptible to breakage. A preferred sleeve 40 has a finish whereby 0% of light is transmitted below 370 nanometers in wavelength in order to further assure ultra violet resistance.

Figure 2A:
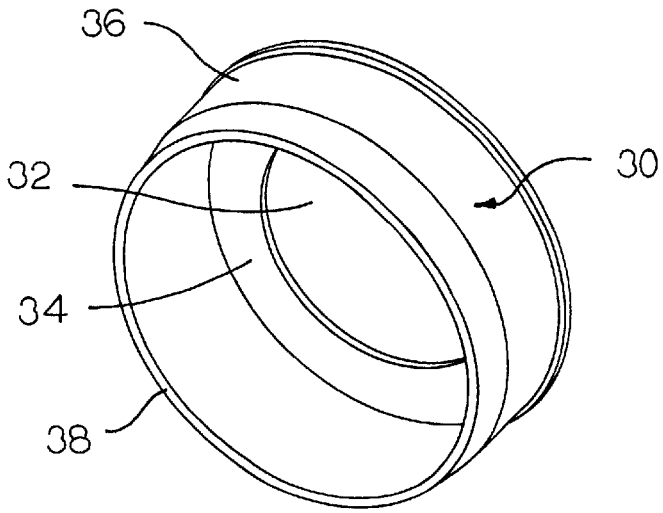
FIG. 2*a* is a perspective view of an end cap of a tube guard system of the present invention.
Figure 2B:
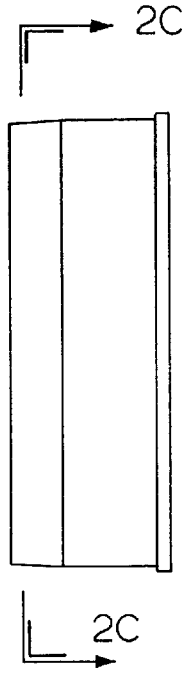
FIG. 2*b* is side view of an end cap of a tube guard system of the present invention.
Figure 2C:
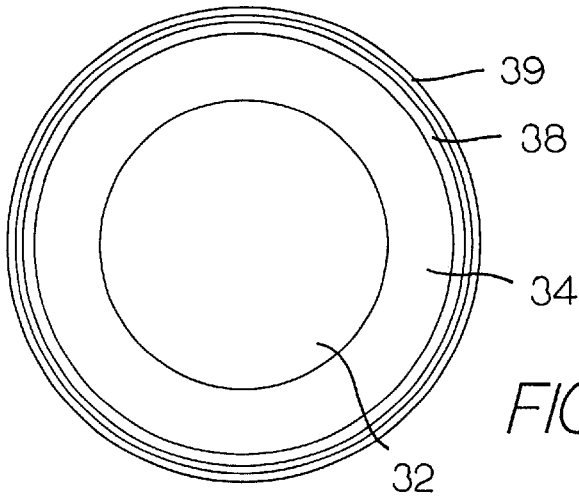
FIG. 2*c* is a sectional view taken along line 2*c*—2*c* of FIG. 2*a* of an end cap of a tube guard system of the present invention.
Figure 3:
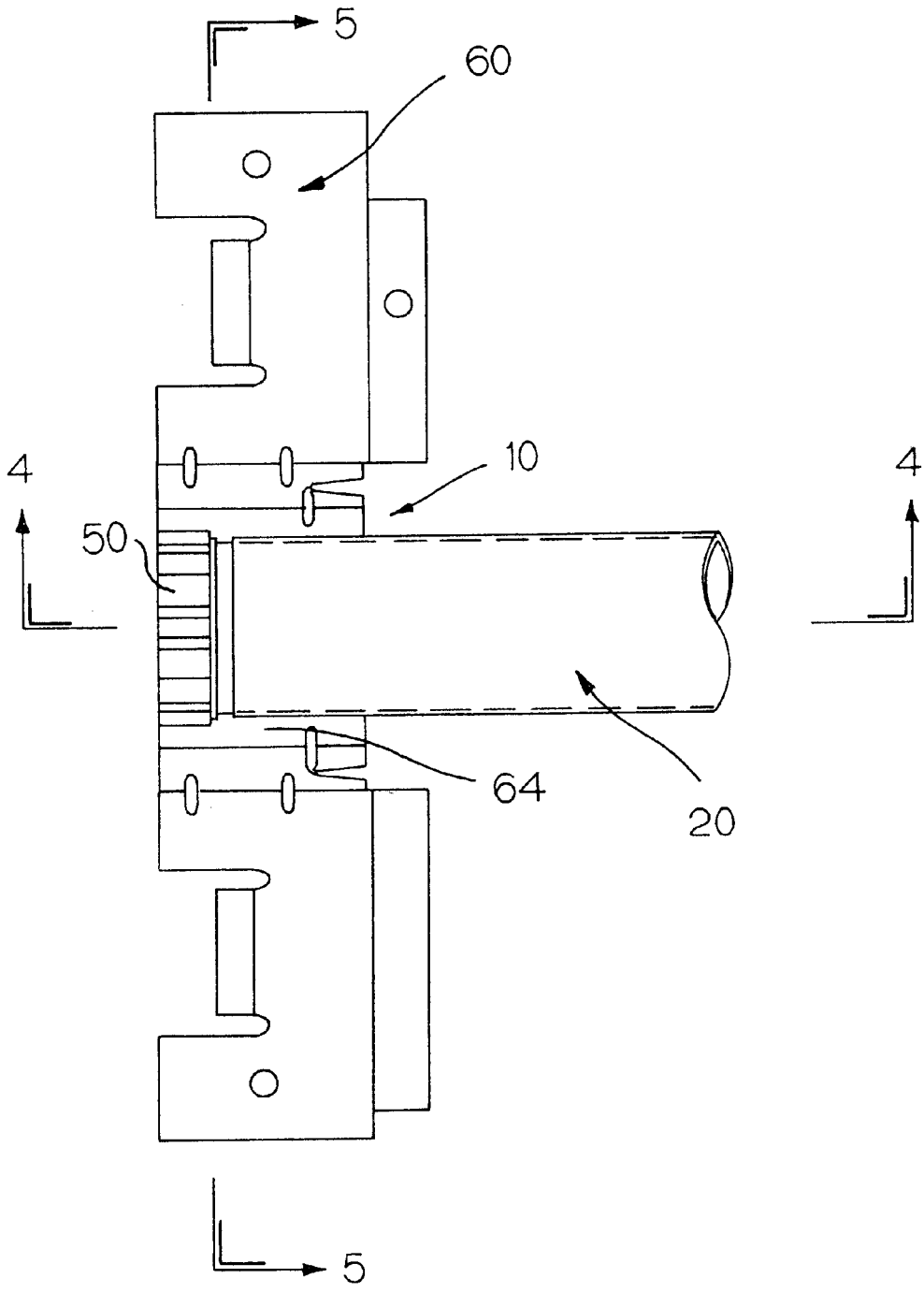
FIG. 3 is a bottom view of a tube guard system of the present invention with selected portions shown in phantom lines.

As shown in FIGS. 2*a*–2*c*, the end cap 30 includes an end wall 34 with an annular skirt 36 depending from the outer periphery therefrom and extending downwardly to a terminating edge 38. An outer periphery of the skirt 36 is tapered to a reduced diameter, as desired, in order to ease fitting the end cap 30 into the sleeve 40. A corresponding sleeve 40 has a diameter matching that of the skirt 36 where it meets a flange 39. The flange 39 having an outer diameter larger than that of the outer diameter of the terminating edge of the skirt 36 protrudes out slightly from the end wall 34. The flange 39 is provided in order to prevent the end cap 30 from sliding fully into the sleeve 40 upon assembling the lamp assembly 20.

Figure 6A:
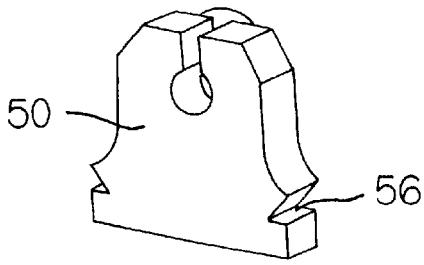
FIG. 6*a* is perspective view of a lampholder of a tube guard system of the present invention.
Figure 6B:
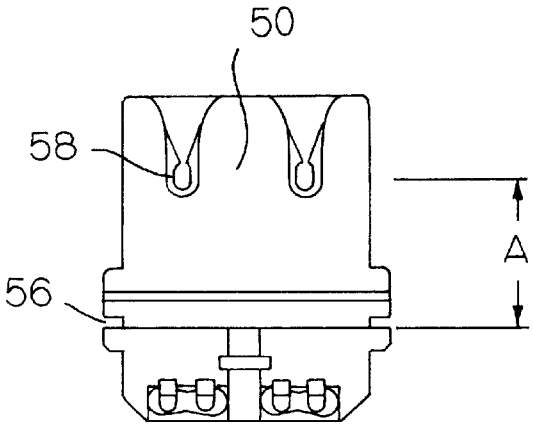
FIG. 6*b* is a an end view of a lampholder of the tube guard system shown in FIG. 6*a;*
Figure 6C:
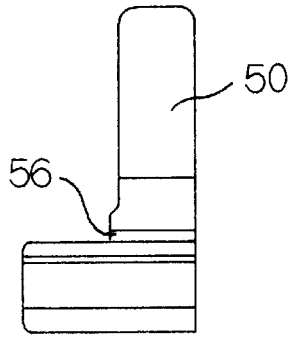
FIG. 6*c* is a side view of FIG. 6*b;*
Figure 6D:
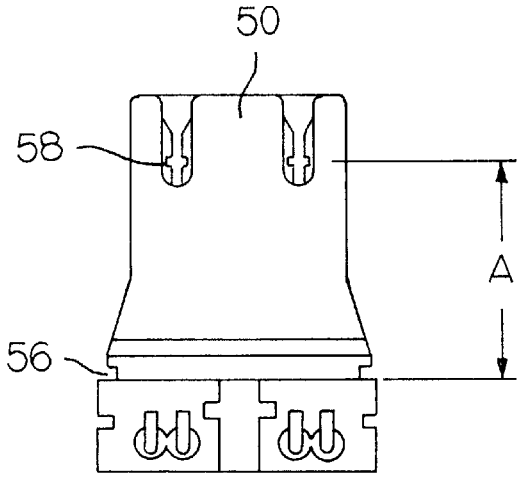
FIG. 6*d* is an end view of another embodiment of the present invention as shown in FIG. 6*a;* and, FIG. 6*e* is a side view of FIG. 6*d.*
Figure 6E:
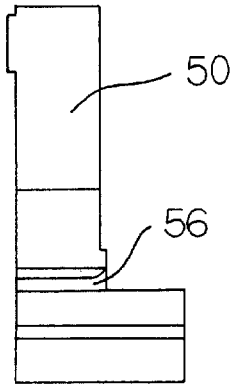

As shown in FIGS. 6*a*–6*e*, a lampholder 50 common in the art is provided for use with the tube guard system 10 of the present invention. Lampholder 50 is preferably mounted to a lampholder saddle 64 as desired. However, an alternative embodiment of the present invention provides that the lampholder 50 is mounted directly to the fixture (not shown) without use of the lampholder saddle 64. The lampholder has a notch 56 formed along an outer edge to receive the base 62 of the saddle 64 of the bracket 60. Slot 58 is provided in order to receive terminal (not shown) of lamp 52. Lampholder 50 as shown in FIGS. 6*b* and 6*c* is a low-profile lampholder 50. Dimension "A" is the same as that shown in FIG. 4, and, again, it is the distance out from the lamp 52 centerline to a base 62 of a saddle 64 of the bracket 60 where the bracket 60 receives the lampholder 50. Dimension "A" is preferably ⅝" when using a low-profile lampholder 50 such as shown in FIGS. 6*b* and 6*c*. When a standard, or high-profile lampholder 50 is desired, as shown in FIGS. 6*d* and 6*e*, dimension "A" increases to ⅞". A preferred embodiment has been manufactured utilizing a "lampholder—Short" and a "lampholder", both supplied by Leviton, for the low-profile and high-profile lampholders 50, respectively. However, many such lampholders 50 are commercially available, and any will work within the dimensional parameters herein discussed.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A tube guard system for use in a flourescent light fixture comprising:

at least one lamp assembly comprising a lamp having two ends and at least one terminal at each said end, a sleeve having two ends and surrounding said lamp, and an end cap having a concentric opening formed thereupon affixed to each said end of said sleeve whereby said terminals protrude through said openings in said end cap, said end cap including an end wall with an annular skirt depending from the outer periphery therefrom and extending downwardly to a terminating edge with a flange extending outwardly from said end wall, said flange having an outer diameter larger than the outer diameter of the terminating edge, said sleeve having a diameter matching that of said flange; and, said at least one terminal at each said end of said lamp being in contacting relation with one of two lampholders mounted at opposite ends to said light fixture.

2. The tube guard system of claim 1 further comprising said lampholder having a lamp center line of at least ⅝".

3. The tube guard system of claim 2, said lampholder sized to receive a lamp of about 1" diameter.

4. The tube guard system of claim 2 said lamp being a T-8 lamp.

5. The tube guard system of claim 1, said sleeve being clear.

6. The tube guard system of claim 1, said sleeve being of preselected ultra-violet-filtering color.

7. The tube guard system of claim 1, an outer periphery of said skirt being tapered to a reduced diameter, whereby said skirt contacts an inner surface of said sleeve and thereby receives said sleeve by friction fit.

8. The tube guard system of claim 7, said sleeve having an inner diameter equal to an outer diameter of said skirt at a junction with said flange, and said inner diameter of said sleeve being at least equal to an outside diameter of said lamp.

9. The tube guard system of claim 1, said end cap being of ultra violet stable, high-heat polypropylene.

10. The tube guard system of claim 1, said sleeve being of light stabilized polycarbonate.

11. The tube guard system of claim 1, said sleeve being of clear light stabilized polycarbonate.

12. The tube guard system of claim 1, said sleeve having a finish sufficient to prevent transmission of light at less than 370 nanometers in wavelength.

13. The tube guard system of claim 1, said lampholders mounted to lampholder saddles, said saddles mounted to said light fixture.

* * * * *

UNITED STATES PATENT AND TRADEMARK OFFICE

CERTIFICATE OF CORRECTION

PATENT NO. : 6,422,721 B1
DATED : July 23, 2002
INVENTOR(S) : Carlton Plunk and Mike Miller It is certified that error appears in the above-identified patent and that said Letters Patent is hereby corrected as shown below:

Column 4,
Line 28, after "at least 5/8" insert -- distance from a lampholder saddle' --.

Signed and Sealed this

Seventeenth Day of December, 2002

JAMES E. ROGAN
*Director of the United States Patent and Trademark Office*